United States Patent [19]

Brisco

[11] 4,104,748

[45] Aug. 8, 1978

[54] HOSPITAL BED AND PATIENT-HANDLING APPARATUS

[76] Inventor: Paul R. Brisco, 3402 Davis St., Oakland, Calif. 94601

[21] Appl. No.: 786,118

[22] Filed: Apr. 8, 1977

[51] Int. Cl.[2] ..... A47C 3/32; A61G 7/00; A61G 7/04

[52] U.S. Cl. ..... 5/63; 5/81 B

[58] Field of Search ..... 5/81 R, 81 B, 60, 61, 5/91, 92, 84, 85, 86, 63

[56] References Cited

U.S. PATENT DOCUMENTS

| | | | |
|---|---|---|---|
| 2,112,702 | 3/1938 | Loibl | 5/81 B |
| 2,565,761 | 8/1951 | Dean | 5/86 |
| 3,945,063 | 3/1976 | Matsuura | 5/81 R |
| 3,967,328 | 7/1976 | Cox | 5/81 R |

*Primary Examiner*—Paul R. Gilliam

*Assistant Examiner*—Alex Grosz

*Attorney, Agent, or Firm*—Warren, Chickering & Grunewald

[57] ABSTRACT

A hospital mattress is formed with a plurality of passages opening to its normally top body-supporting surface; a plurality of members are mounted for reciprocation in the passages and formed with body-engaging ends normally disposed at or below the surface in a body-supporting position thereof; means is provided for simultaneously displacing the members or engaging and elevating a body on the mattress and to provide horizontally spaced access spaces between the body and the mattress; and movable gurney arms are formed to enter the access spaces for receiving, supporting and transfer of the body onto the gurney. The apparatus is adapted to operate in a reverse fashion to transfer the body from the gurney to the bed.

10 Claims, 10 Drawing Figures

HOSPITAL BED AND PATIENT-HANDLING APPARATUS

BACKGROUND OF THE INVENTION

The invention relates to hospital patient-handling apparatus designed for transfer of patients between hospital beds and gurneys or stretchers and the like, see for example, U.S. Pat. Nos. 3,786,523 and 3,945,063.

There has existed a most serious problem in hospitals and other medical facilities in the effecting of a transfer of an immobilized, injured or otherwise suffering patient between a gurney and a hospital bed, and the problem is made more acute with heavy or obese patients. In many instances, the movement of the patient is accompanied by extraordinary pain and likelihood of severely aggravating the ailment or injury for which the patient is being treated.

An object of the present invention is to provide a hosiptal bed and patient-handling apparatus of the character described which will enable the transfer of a patient from the bed to the gurney and vice versa with a gentle, smooth handling of the patient and with ease and facility and without requiring rolling, sliding or significant change in position of the patient.

Another object of the present invention is to provide a patient-handling apparatus of the character above in which the patient may be transferred between the bed and gurney by a single nurse or attendant with minimal physical effort and with complete safety to the patient.

A further object of the present invention is to provide apparatus of the character above which may be furnished and maintained at modest cost.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF INVENTION

Figure 1:
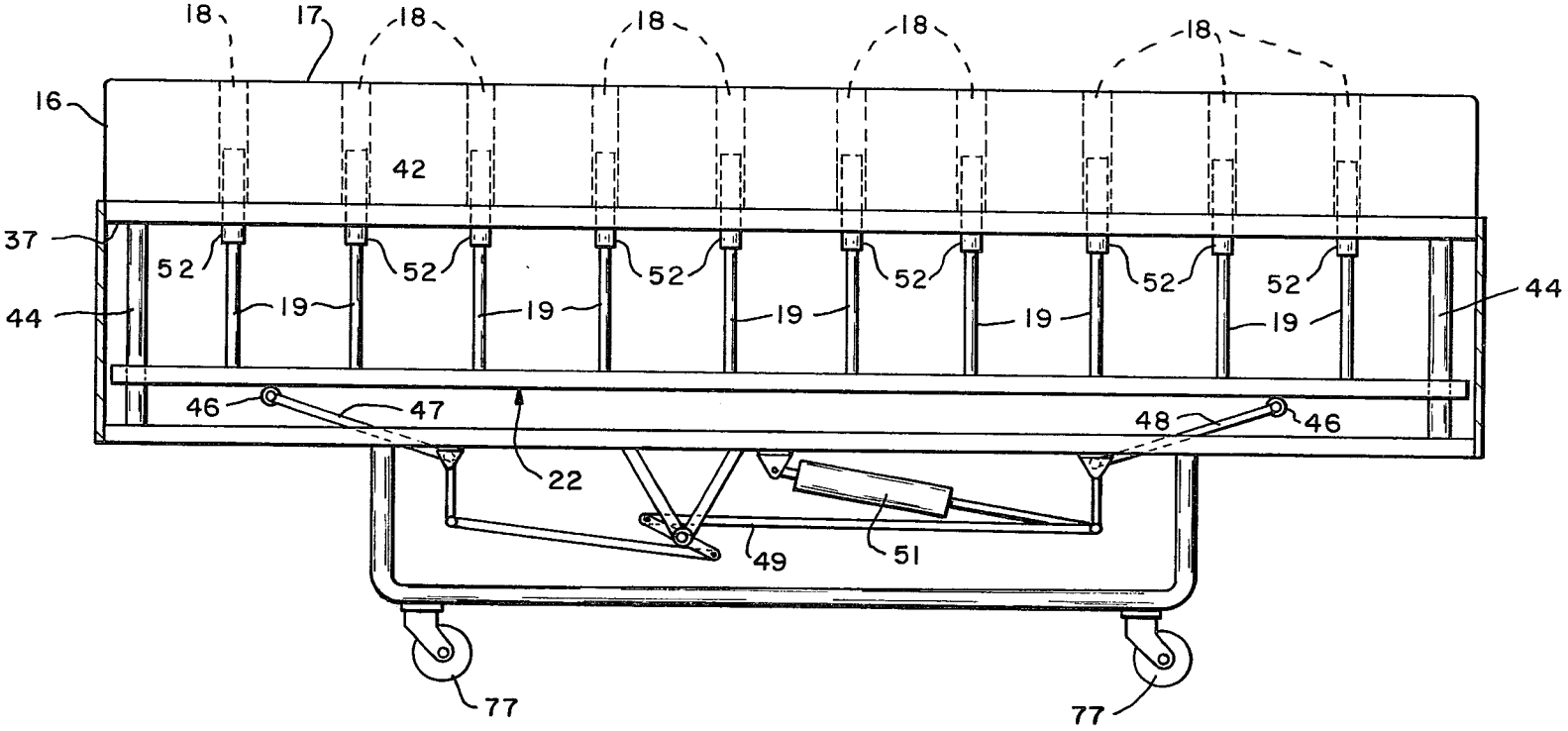
FIG. 1 is a side elevation of a hosiptal bed constructed in accordance with the present invention.
Figure 3:
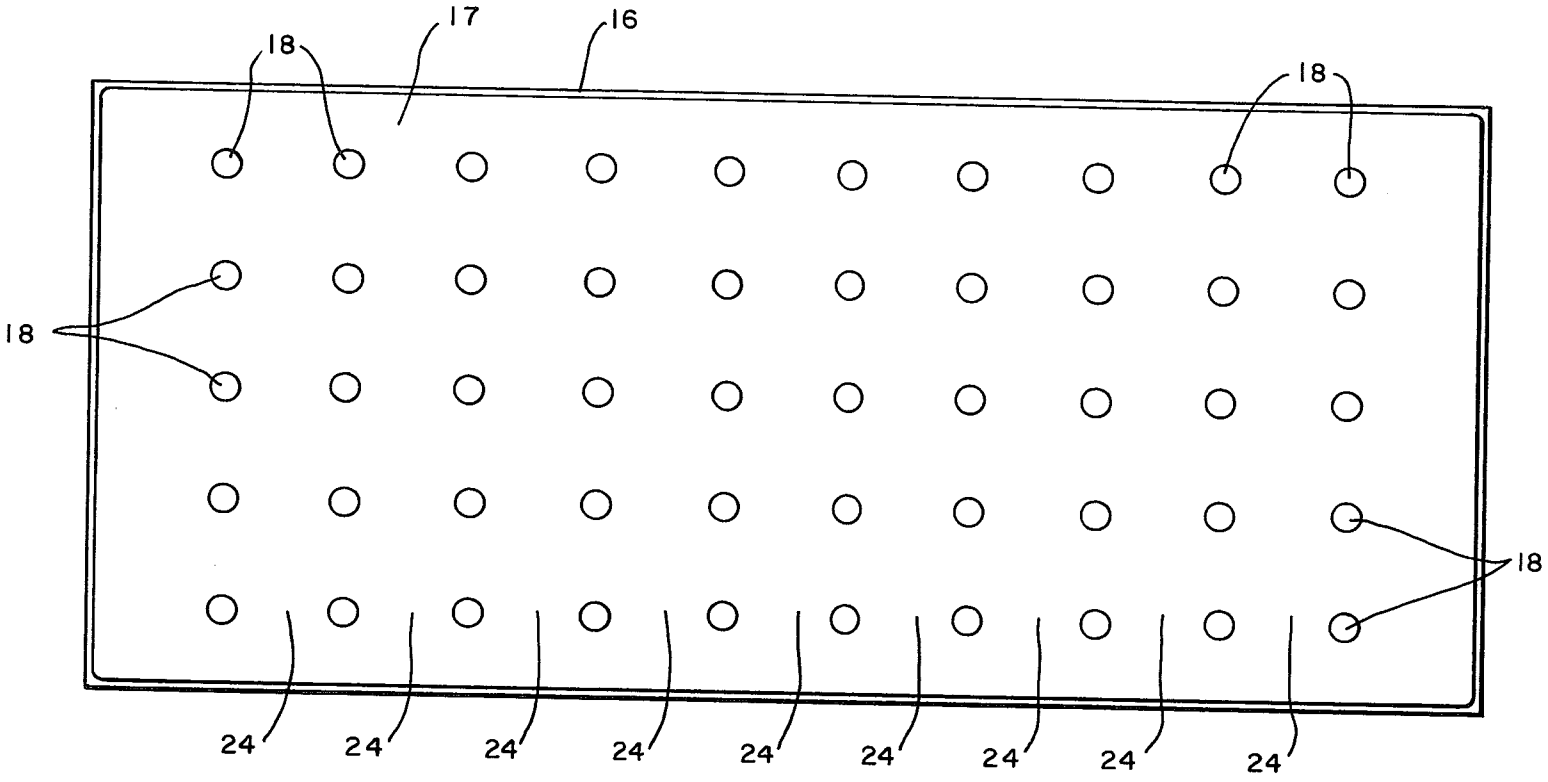
FIG. 3 is a top plan view of the bed.
Figure 6:
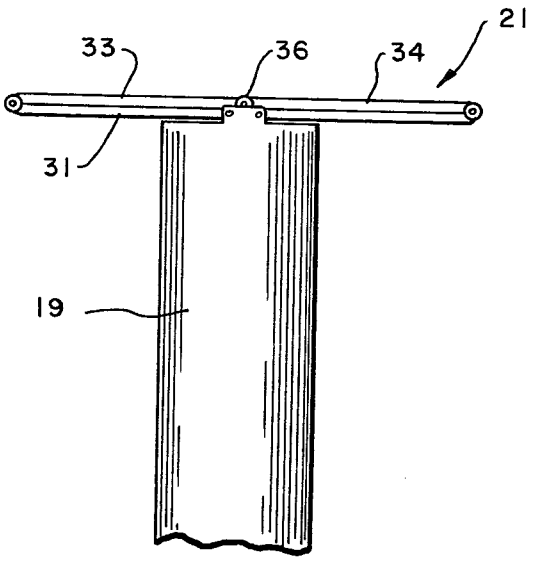
FIG. 6 is a side elevation of the structure illustrated in FIGS. 4 and 5 and is taken at right angles to the showing of FIG. 5 and with the parts in a displaced body-supporting position.
Figure 5:
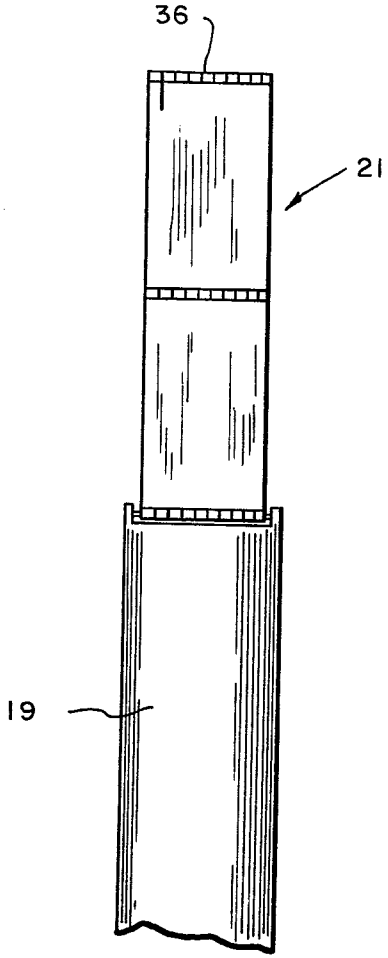
FIG. 5 is a side elevation of the structure illustrated in FIG. 4.
Figure 4:
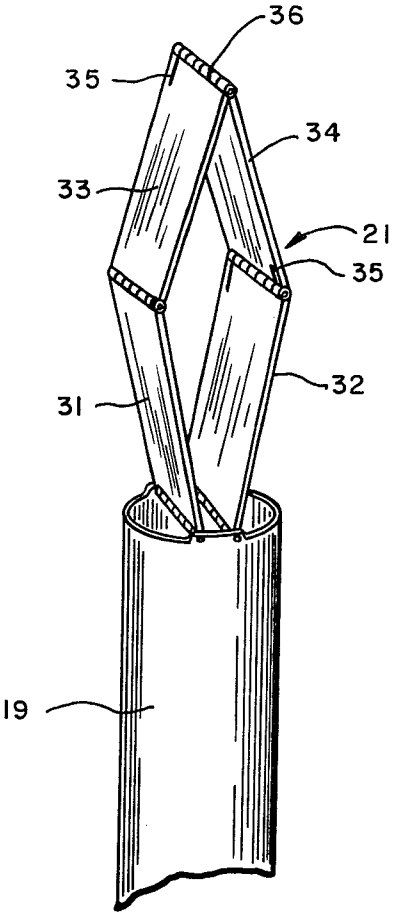
FIG. 4 is a fragmentary perspective view on an enlarged scale of a part of the bed structure.
Figure 7:
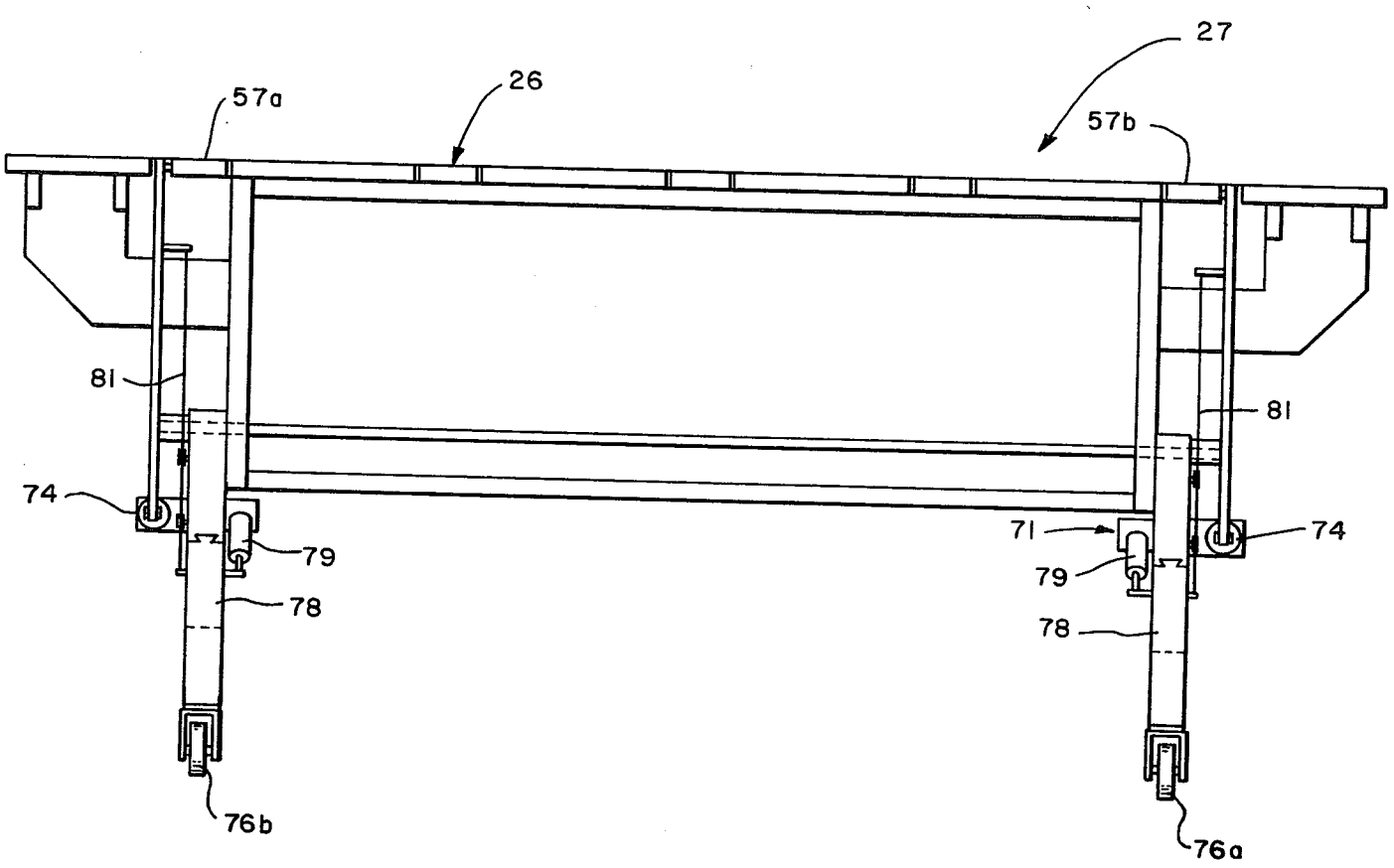
FIG. 7 is a side elevation of the gurney forming part of the present invention.

The apparatus of the present invention comprises, briefly, a mattress 16 formed with a normally upper, horizontally disposed body-supporting surface 17 and formed with a plurality of passages 18 opening to surface 17; a plurality of members 19 mounted for reciprocation in passages 18, one for each passage, and having body-engaging ends, see FIGS. 4-6, normally disposed at or below surface 17 in a body-supporting position of the surface; and means 22 for simultaneously displacing members 19 relative to passages 18 for engaging and elevating a body 23 relative to the mattress, see FIG. 10. Of importence, passages 18 and members 19 are spaced horizontally from each other, as will be observed in FIGS. 1 and 3, so as to provide in the advanced body-supporting position of the members, see FIG. 10, a plurality of substantially horizontal access spaces therebetween; and means 26, here forming part of a gurney 27, see FIGS. 7-10, is dimensioned for entering spaces 24 and for positioning between the body 23 and mattress surface 17 for receiving and supporting body 23 upon retraction of members 19 to surface 17.

As a further feature of the present invention, means is provided at the body-engaging ends 21 of members 19 which will automatically respond to body engagement to provide automatic pressure-responsive broadening of the area of body contact. Various structures may be used for this purpose. As here shown in FIGS. 4, 5 and 6, hinged foldable plates are mounted at the upper ends of members 19, including a first pair of plates 31 and 32 hinged to each of members 19 and a second pair of plates 33 and 34 hinged to plates 31 and 32 and to each other to provide an articulated structure movable between an extended diamond-shaped configuration extending longitudinally from members 19, see FIG. 4, and a retracted flattened position extending transversely across the upper ends of members 19 to provide the aforementioned broadened area of support. One or more springs, see spring ends 35, are, preferably, incorporated in one or more of the hinges joining the plates, biasing the latter to their extended configuration, as seen in FIG. 4. As the top hinged joint 36 moves up against the underside of body 23, the hinged structure will progressively collapse to the flattened form illustrated in FIG. 6, providing a broad area of support.

Figure 2:
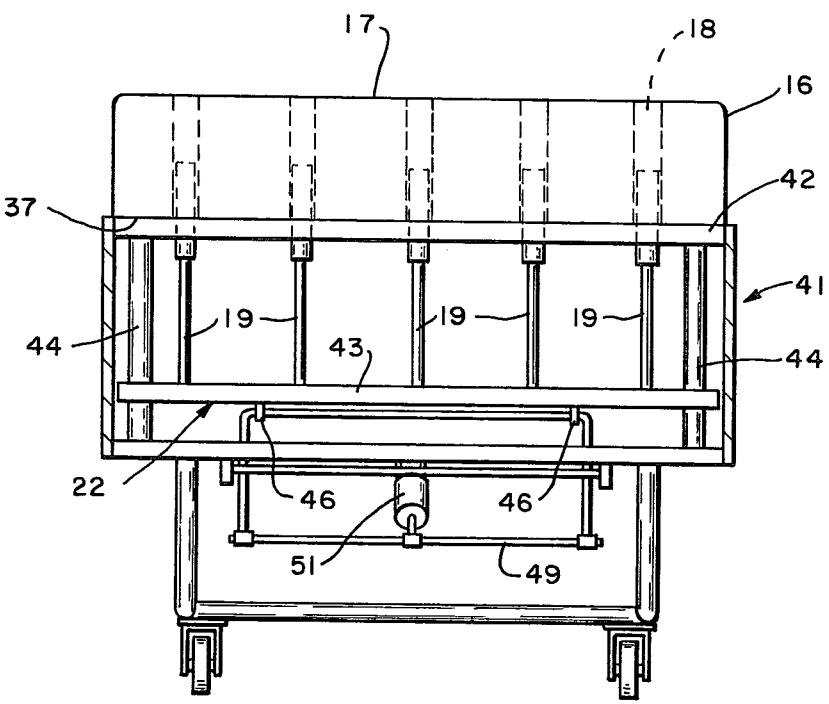
FIG. 2 is an end elevation of the bed.

Passages 18 are, preferably, of elongated form extending through mattress 16 between its upper surface 17 and its normally bottom surface 37 perpendicularly to the surfaces and with the longitudinal axes of the passages substantially parallel in a normally vertical orientation. Also, as will be best seen in FIG. 3, the passages are disposed in longitudinally spaced, transversely extending rows providing between the rows the access spaces 24 above noted. Support for mattress 16 is here provided by a bed frame 41 having a platform 42 supporting the underside 37 of the mattress and a relatively lower vertically reciprocating platform 43 to which the lower ends of members 19 are connected for joint vertical movement through passages 18. A suitable means may be used for raising and lowering platform 43. As here shown, the platform is carried between guides 44 for vertical reciprocation and is engaged at its underside by rollers 46 carried at the ends of bell cranks 47 and 48 tied to a common like frame 49, which is, in turn, connected to a hydraulic actuator 51 carried by the bed frame, see FIGS. 1 and 2. Upon contraction of actuator 51, see FIG. 1, bell cranks 47 and 48 will be rotated to effect raising of platform 43 and joint raising of members 19. Preferably, a plurality of vertically set tubular guides 52 for members 19 are carried by and extend vertically through the upper platform 42 and into passages 18 so as to maintain a constant vertical registration of members 19 and passages 18. Plates 31–34 are dimensioned for moving through guides 52 in their diamond-shaped configuration, as seen in FIG. 4.

Figure 8:
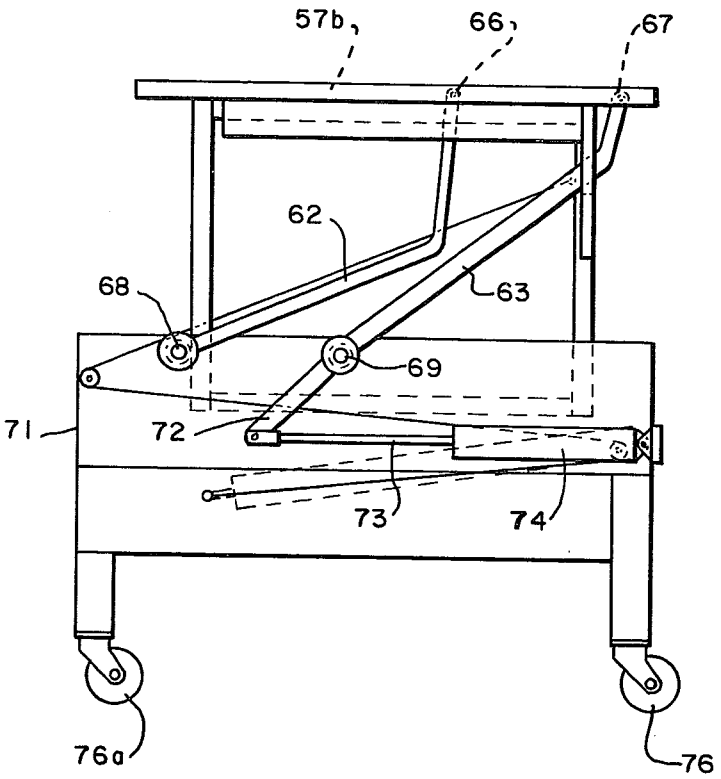
FIG. 8 is an end elevation of the gurney illustrated in FIG. 7.
Figure 9:
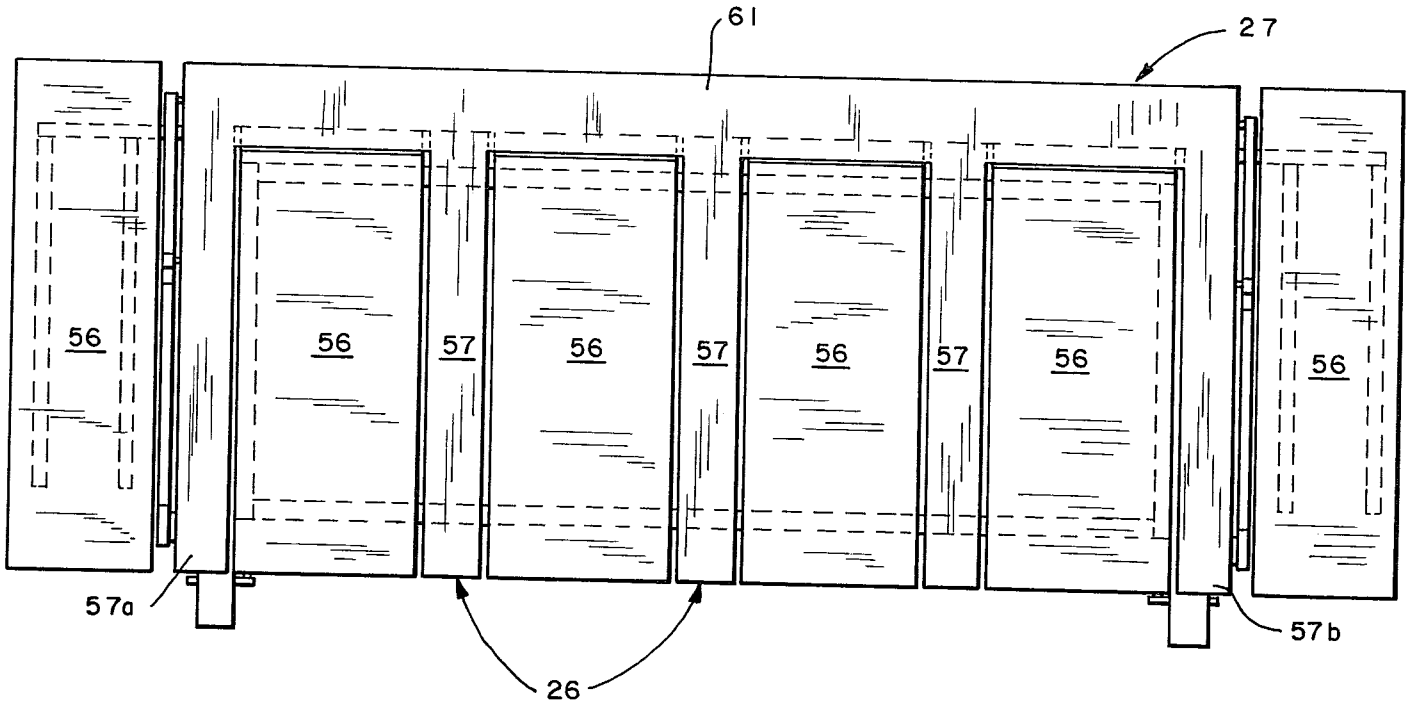
FIG. 9 is a top plan view of the gurney.
Figure 10:
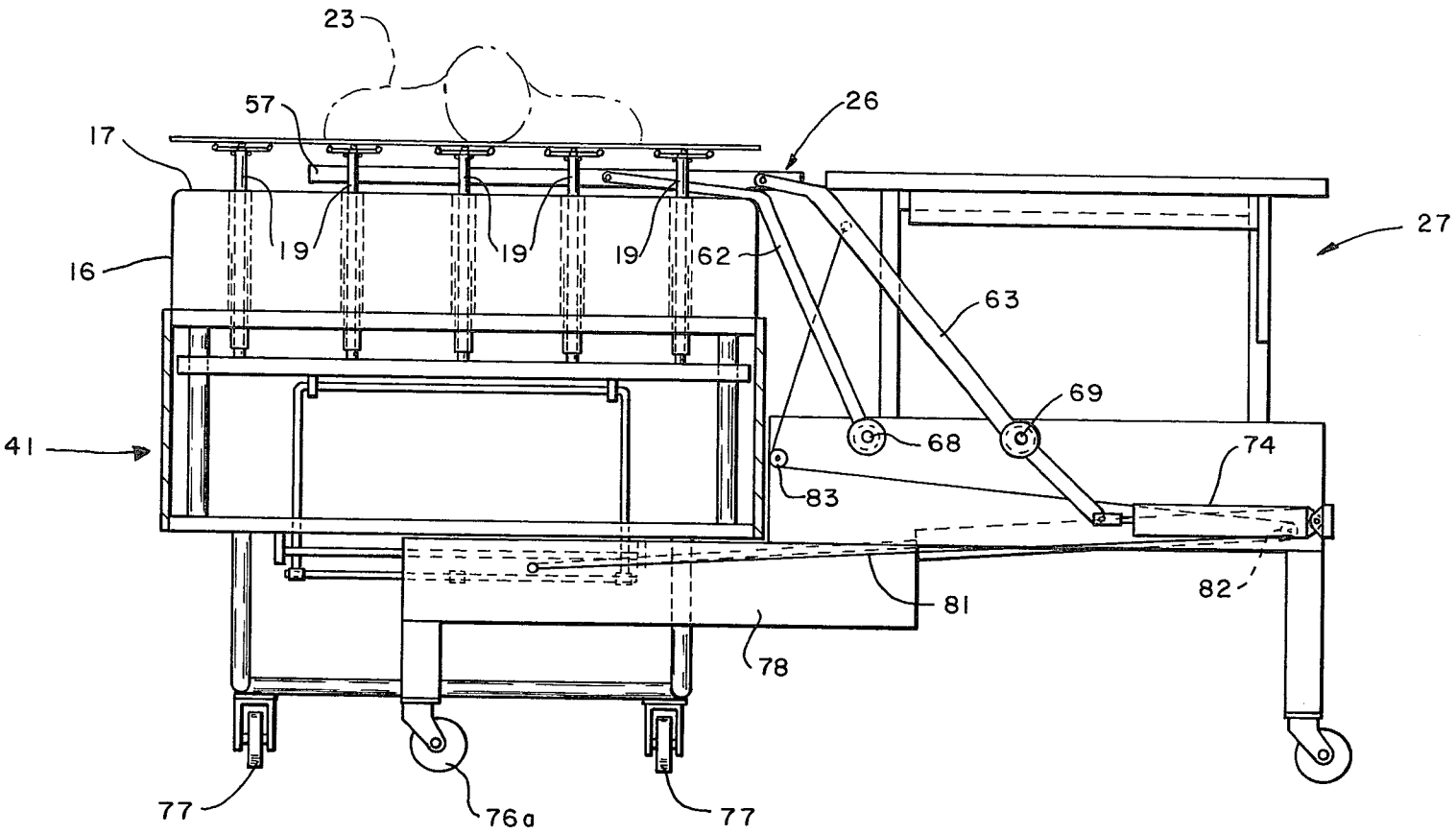
FIG. 10 is an end elevation of the bed and gurney shown in cofunctioning position.

As hereinabove noted, the gurney, FIGS. 7–10, is constructed to function cooperatively with the bed and mattress above described to provide a gentle, smooth handling of a patient in effecting transfer of the patient between the gurney and the bed and to do so with ease and facility and with maximum comfort and safety to the patient. With reference to FIG. 9, it will be seen that the gurney has a normally horizontal body-supporting area composed of fixed segments 56 and movable segments 57 comprising the aforementioned means 22. Segments 57 are mounted for reciprocal movement between a retracted position forming part of the body-supporting area of the gurney and an extended position projecting laterally from the area, as seen in FIG. 10; and segments 57 are dimensioned for entering the access spaces 24 when in extended position for transfer of a body between segments 57 and the upper ends 21 of members 19. Typically, if body 23 is to be transferred from bed 41 to gurney 27, members 19 are first raised by means 22 so as to engage the underside of and raise the body into a spaced elevated position over the upper surface 17 of the mattress. Gurney 27, having theretofore been brought alongside of the bed, is operated to extend segments 57 laterally into the access spaces provided between the members 19 and between the body and the mattress, as seen in FIG. 10. Members 19 will then be lowered to transfer the body onto segments 57, whereupon the segments, with the body resting thereon, will be moved to their retracted position between fixed segments 56 to provide a full flush surface support for the body. To return a body from the gurney to the bed, the several parts are cycled through a reverse operation. The body is picked up by segments 57 and moved laterally into superimposed position over the top surface 17 of the mattress. Members 19 are elevated to pick up the support of the body from the segments 57, after which the latter are withdrawn or retracted to the gurney. In accomplishing the foregoing, segments 57 move horizontally while maintained in a common horizontal plane with minimum disturbance and discomfort to the body. This is here effected by securing all of the segments to a common back-supporting beam 61 and by displacement of the beam and segments cantilevered therefrom by a parallelogram leverage system, best seen in FIGS. 8 and 10. With reference to FIGS. 7–10, a pair of lever arms 62 and 63 are connected by horizontally spaced pivots 66 and 67 to the end segments **57*a* and 57*b* of the movable top array of segments and are journalled for rotation on pivots 68 and 69 connecting the lever arms to the frame 71 of the gurney. As will be noted in FIGS. 8 and 10, pivots 68 and 69 are spaced horizontally from each other by a distance equal to the spacing of pivots 66 and 67 so as to provide a parallelogram structure. One end 72 of lever arm 63 is here connected to the actuator shaft 73 of a frame-supported, hydraulic actuator 74 used for powering the movable top section between its retracted and extended positions. Energizing of actuator 74 in the position of the parts illustrated in FIG. 8 will cause a counterclockwise rotation of arms 62 and 63 and a swinging of the top gurney section to the left, as seen in the drawing, while maintaining all parts of the section in a horizontal plane. Reverse energizing of actuator 74 is used to return the movable top gurney section from its extended position, as seen in FIG. 10, to its retracted position, as seen in FIG. 8. Such reverse energizing of the actuator will cause arms 62 and 63 to swing jointly as a parallelogram in a clockwise direction, again maintaining the top gurney section perfectly flat and horizontal. Some arcuate displacement of the top section takes place, and which may be used to assist in the transfer of the body between the gurney section and the bed members 19. The foregoing description of operation of the lever arms and hydraulic actuator applies to either end of the gurney, it being observed that a pair of arm 62–63 and an actuator 74 are provided at the opposite ends of the gurney, see FIGS. 7 and 9**, the hydraulic cylinders being connected for operation together as a unit.

The gurney is, of course, mounted on wheels 76 for convenient rolling about on a hospital floor. The hospital bed 41 may also be provided with conventional supporting casters 77. However, in the case of the gurney, a pair of the supporting wheels **76*a* are mounted on a frame slide 78, one at each end of the gurney, and which move out to widen the stance of the gurney when the latter is moved into position alongside of a bed for patient-transfer operation, as above explained, see FIG. 10. Displacement of frame slide 78 to its extended position is here effected by a hydraulic cylinder 79 connected between the gurney frame 71 and slide 78, a pair of such cylinders being connected to operate the pair of slides at the opposite ends of the gurney, see FIG. 7. Retraction of this slide, however, to its normal gurney roll-about position is here conveniently effected by a cable 81 attached at one end to slide 78 and which is carried around a pair of frame-supported pulleys 82 and 83 and attached at its opposite end to lever arm 63, see FIGS. 8 and 10. As will be observed, retraction of lever arm 63 from its extended position, as seen in FIG. 10, will cause a pulling of the lower slide-secured end of the cable to the right, as seen in the view, thereby returning the slide and wheels 76*a* and cylinder 79 to retracted position. Again, the structure is repeated at opposite ends of the gurney with the two cylinders 79** connected hydraulically for joint operation.

What is claimed is:

1. In combination:

a mattress formed with a plurality of longitudinally spaced transversely extending rows of passages extending between the normally upper body-supporting surface and lower mattress-supporting surface and defining access spaces between said rows;

a platform engaging and supporting said lower surface of said mattress;

a plurality of vertically set tubular guides mounted on said platform and extending into said passages;

a plurality of members mounted for reciprocation in said guides, one in each of said guides, and having body-engaging ends normally positioned at or below said upper surface in a body-supporting position of said upper surface;

means for simultaneously displacing said members in said guides for extension above said upper surface for engaging and elevating a body thereon, certain of said members defining in their advanced body supporting position said access spaces;

means dimensioned for entering said access spaces and for positioning between an elevated body and upper mattress surface for receiving and supporting said body upon retraction of said members to said upper surface.

2. The structure of claim 1, and hinged foldable plates mounted on said upper ends of said members and dimensioned for moving through said guides and functioning on engagement with and movement against the under side of said body to move into a broadened area of support on said body.

3. The structure of claim 2, a first pair of said plates being hinged to each of said members and a second pair of said plates being hinged to said first pair of plates and to each other to provide an articulated structure movable between an extended diamond-shaped configuration extending longitudinally from said members and a retracted flattened position extending transversely across the upper ends of said members to provide said broadened area of support;

spring means biasing said plates to extended configuration; and said plates in extended configuration being dimensioned to move through said guides and functioning on engagement with said body to move to retracted position against the resistance of said spring means.

4. The structure of claim 1, said last-named means comprising a gurney having a normally horizontal body-supporting area composed of segments;

certain of said segments being mounted for reciprocal movement between a retracted position forming part of said area and an extended position projecting laterally from said area; and said certain segments being dimensioned for entering said access spaces when in extended position for transfer of a body between said certain segments and said members.

5. The structure of claim 4, said gurney being movable to dispose said area into substantially contiguous position with said body-supporting surface of said mattress; and means for displacing said certain segments between retracted and extended positions while constantly maintaining said certain segments horizontally disposed.

6. The structure of claim 5, said last-named means providing displacement of said certain segments in an arcuate path while maintaining said certain segments in a series of horizontal planes.

7. The structure of claim 6, said gurney being supported on roll-about wheels; and means automatically displacing certain of said wheels from a normal to a widened stance upon movement of said certain segments to extended position.

8. The structure of claim 7, and means automatically retracting said certain wheels to normal stance upon retraction of said certain segments to said gurney body-supporting area.

9. For use with a bed providing elevation of a body thereon and a plurality of horizontal access spaces under said body, a gurney comprising:

a normally horizontal body-supporting area composed of segments;

certain of said segments being mounted for reciprocal movement between a retracted position forming part of said area and an extended position projecting laterally from said area;

said certain segments being dimensioned for entering said access spaces when in extended position for transfer of a body;

means for displacing said certain segments between retracted and extended positions while constantly maintaining said certain segments horizontally disposed;

a plurality of roll-about wheels providing the support for said gurney; and means automatically displacing certain of said wheels from a normal to a widened stance upon movement of said certain segments to extended position and automatically retracting said certain wheels to normal stance upon retraction of said certain segments to said gurney body-supporting area.

10. The gurney of claim 9, said first-named means providing said displacement of said certain segments in an arcuate path while maintaining said certain segments in a series of horizontal planes.

* * * * *